US008006753B2

(12) United States Patent
Swietlik et al.

(10) Patent No.: US 8,006,753 B2
(45) Date of Patent: Aug. 30, 2011

(54) HYDRAULIC CONNECTOR APPARATUSES AND METHODS OF USE WITH DOWNHOLE TUBULARS

(75) Inventors: George Swietlik, Lowestoft (GB); Robert Large, Lowestoft (GB)

(73) Assignee: Pilot Drilling Control Limited, Suffolk (GB)

( * ) Notice: Subject to any disclaimer, the term of this patent is extended or adjusted under 35 U.S.C. 154(b) by 172 days.

(21) Appl. No.: 12/368,217

(22) Filed: Feb. 9, 2009

(65) Prior Publication Data

US 2009/0205836 A1 Aug. 20, 2009

Related U.S. Application Data

(63) Continuation-in-part of application No. 11/703,915, filed on Feb. 8, 2007, now Pat. No. 7,690,422.

(30) Foreign Application Priority Data

| | | |
|---|---|---|
| Feb. 8, 2006 | (GB) | 0602565.4 |
| Feb. 8, 2008 | (GB) | 0802406.9 |
| Feb. 8, 2008 | (GB) | 0802407.7 |
| Mar. 20, 2008 | (GB) | 0805299.5 |

(51) Int. Cl.
*E21B 19/00* (2006.01)
*E21B 34/00* (2006.01)

(52) U.S. Cl. ..... 166/90.1; 166/85.5; 166/332.8; 166/334.4; 166/332.1

(58) Field of Classification Search ..... 166/90.1, 166/85.5, 332.8, 334.4, 332.1, 334.1
See application file for complete search history.

(56) References Cited

U.S. PATENT DOCUMENTS

| | | | |
|---|---|---|---|
| 2,748,871 | A | 6/1956 | Brown |
| 3,120,272 | A | 2/1964 | Cochran |
| 3,874,634 | A | 4/1975 | Gazda |
| 4,364,407 | A | 12/1982 | Hilliard |
| 4,377,179 | A | 3/1983 | Giebeler |
| 4,495,073 | A | 1/1985 | Beimgraben |
| 4,625,755 | A | 12/1986 | Reddoch |
| 4,658,905 | A | 4/1987 | Burge |
| 4,997,042 | A | 3/1991 | Jordan et al. |
| 5,133,419 | A | 7/1992 | Barrington |
| 5,191,939 | A | 3/1993 | Stokley |
| 5,501,280 | A | 3/1996 | Brisco |
| 5,584,343 | A | 12/1996 | Coone |

(Continued)

FOREIGN PATENT DOCUMENTS

| | | |
|---|---|---|
| EP | 0692345 A1 | 1/1996 |

(Continued)

OTHER PUBLICATIONS

International Search Report for Patent Application No. PCT/GB2010/000229, dated Apr. 6, 2010 (14 pages).

(Continued)

*Primary Examiner* — Giovanna C Wright
(74) *Attorney, Agent, or Firm* — Osha • Liang LLP

(57) ABSTRACT

A tool to direct a fluids from a lifting assembly and a bore of a downhole tubular includes an engagement assembly configured to selectively extend and retract a seal assembly disposed at a distal end of the tool into and from a proximal end of the downhole tubular and a valve assembly operable between an open position and a closed position, wherein the valve assembly is configured to allow fluids from the lifting assembly to enter the downhole tubular through the seal assembly when in the closed position and wherein the valve assembly is configured to allow fluids from the downhole tubular to be diverted from the lifting assembly when in the open position.

31 Claims, 8 Drawing Sheets

U.S. PATENT DOCUMENTS

| | | | |
|---|---|---|---|
| 5,682,952 | A | 11/1997 | Stokley |
| 5,735,348 | A | 4/1998 | Hawkins, III |
| 5,890,538 | A | 4/1999 | Beirute et al. |
| 5,918,673 | A | 7/1999 | Hawkins et al. |
| 5,971,079 | A | 10/1999 | Mullins |
| 6,173,777 | B1 | 1/2001 | Mullins |
| 6,279,654 | B1 | 8/2001 | Mosing et al. |
| 6,390,190 | B2 | 5/2002 | Mullins |
| 6,415,862 | B1 | 7/2002 | Mullins |
| 6,460,620 | B1 | 10/2002 | LaFleur |
| 6,571,875 | B2 | 6/2003 | Bissonnette et al. |
| 6,571,876 | B2 | 6/2003 | Szarka |
| 6,578,632 | B2 | 6/2003 | Mullins |
| 6,604,578 | B2 | 8/2003 | Mullins |
| 6,666,270 | B2 | 12/2003 | Vann |
| 6,675,889 | B1 | 1/2004 | Mullins et al. |
| 6,715,542 | B2 | 4/2004 | Mullins |
| 6,722,425 | B2 | 4/2004 | Mullins |
| 6,732,804 | B2 | 5/2004 | Hosie et al. |
| 6,779,599 | B2 | 8/2004 | Mullins et al. |
| 6,883,605 | B2 | 4/2005 | Arceneaux et al. |
| 7,028,769 | B2 | 4/2006 | Mullins |
| 7,096,948 | B2 | 8/2006 | Mosing et al. |
| 7,690,422 | B2 | 4/2010 | Swietlik et al. |
| 2002/0129934 | A1 | 9/2002 | Mullins et al. |
| 2005/0000695 | A1 | 1/2005 | LaFleur |
| 2005/0173154 | A1 | 8/2005 | Lesko |

FOREIGN PATENT DOCUMENTS

| | | | |
|---|---|---|---|
| EP | 1019614 | A1 | 7/2000 |
| EP | 1260671 | | 11/2002 |
| EP | 1632640 | | 3/2006 |
| GB | 2074634 | A | 11/1981 |
| GB | 2156402 | A | 10/1985 |
| GB | 2394973 | | 5/2004 |
| GB | 2435059 | A | 8/2007 |
| GB | 2439427 | A | 12/2007 |
| WO | 0061909 | | 10/2000 |
| WO | 2005090740 | | 9/2005 |
| WO | 2007127737 | | 11/2007 |

OTHER PUBLICATIONS

International Search Report for Patent Application No. PCT/GB2010/000230, dated Apr. 6, 2010 (14 pages).

International Search Report for Patent Application No. PCT/GB2009/000349, dated Jun. 24, 2009 (15 pages).

International Search Report for Patent Application No. PCT/GB2009/000339, dated Jul. 8, 2009 (13 pages).

International Search Report for Patent Application No. PCT/GB2009/000338, dated Jul. 9, 2009 (6 pages).

International Search Report for Patent Application No. PCT/GB2009/000344, dated Jul. 9, 2009 (6 pages).

Mechanical English translation of European Patent Application No. EP1632640, published Mar. 8, 2006 (6 pages).

International Search Report for Patent Application No. PCT/GB2009/000344, dated Oct. 6, 2009 (18 pages).

International Search Report for Patent Application No. PCT/GB2009/000338, dated Oct. 13, 2009 (19 pages).

Canadian Association of Oilwell Drilling Contractors (CAODC), "SI Drilling Manual 1st Edition", Gulf Publishing Company, Section B20, p. 1.

Office Action in U.S. Appl. No. 12/368,199, dated Dec. 21, 2010 (24 pages).

Office Action in U.S. Appl. No. 12/368,161, dated Oct. 21, 2010 (26 pages).

Unknown, "Circulating/flowback tool cuts surge pressures," Drilling Contractor, Mar./Apr. 2001, pp. 30-31 (2 pages).

Video from the website www.drawworkslp.com <http://www.drawworkslp.com/page/78/video-resources>.

HYDRAULIC CONNECTOR APPARATUSES AND METHODS OF USE WITH DOWNHOLE TUBULARS

CROSS-REFERENCE TO RELATED APPLICATIONS

The present application claims benefit under 35 U.S.C. §120, as a Continuation-In-Part, to U.S. patent application Ser. No. 11/703,915, filed Feb. 8, 2007, now U.S. Pat. No. 7,690,422 which, in-turn, claims priority to United Kingdom Patent Application No. 0602565.4 filed Feb. 8, 2006. Additionally, the present application claims priority to United Kingdom Patent Application No. 0802406.9 and United Kingdom Patent Application No. 0802407.7, both filed on Feb. 8, 2008. Furthermore, the present application claims priority to United Kingdom Patent Application No. 0805299.5 filed Mar. 20, 2008. All priority applications and the co-pending U.S. parent application are hereby expressly incorporated by reference in their entirety.

BACKGROUND OF THE DISCLOSURE

1. Field of the Disclosure

The present disclosure generally relates to a connector establishing a fluid-tight connection to a downhole tubular. More particularly, the present disclosure relates to a connector establishing a fluid-tight connection between a downhole tubular and a lifting assembly. Alternatively, the present disclosure relates to a connector establishing a fluid-tight connection between a downhole tubular and another tubular.

2. Description of the Related Art

It is known in the industry to use a top-drive assembly to apply rotational torque to a series of inter-connected tubulars (commonly referred to as a drillstring comprised of drill pipe) to drill subterranean and subsea oil and gas wells. In other operations, a top-drive assembly may be used to install casing strings to already drilled wellbores. The top-drive assembly may include a motor, either hydraulic, electric, or other, to provide the torque to rotate the drillstring, which in turn rotates a drill bit at the bottom of the well.

Typically, the drillstring comprises a series of threadably-connected tubulars (drill pipes) of varying length, typically about 30 ft (9.14 m) in length. Typically, each section, or "joint" of drill pipe includes a male-type "pin" threaded connection at a first end and a corresponding female-type "box" threaded connection at the second end. As such, when making-up a connection between two joints of drill pipe, a pin connection of the upper piece of drill pipe (i.e., the new joint of drill pipe) is aligned with, threaded, and torqued within a box connection of a lower piece of drill pipe (i.e., the former joint of drill pipe). In a top-drive system, the top-drive motor may also be attached to the top joint of the drillstring via a threaded connection.

During drilling operations, a substance commonly referred to as drilling mud is pumped through the connection between the top-drive and the drillstring. The drilling mud travels through a bore of the drillstring and exits through nozzles or ports of the drill bit or other drilling tools downhole. The drilling mud performs various functions, including, but not limited to, lubricating and cooling the cutting surfaces of the drill bit. Additionally, as the drilling mud returns to the surface through the annular space formed between the outer diameter of the drillstring and the inner diameter of the borehole, the mud carries cuttings away from the bottom of the hole to the surface. Once at the surface, the drill cuttings are filtered out from the drilling mud and the drilling mud may be reused and the cuttings examined to determine geological properties of the borehole.

Additionally, the drilling mud is useful in maintaining a desired amount of head pressure upon the downhole formation. As the specific gravity of the drilling mud may be varied, an appropriate "weight" may be used to maintain balance in the subterranean formation. If the mud weight is too low, formation pressure may push back on the column of mud and result in a blow out at the surface. However, if the mud weight is too high, the excess pressure downhole may fracture the formation and cause the mud to invade the formation, resulting in damage to the formation and loss of drilling mud.

As such, there are times (e.g., to replace a drill bit) where it is necessary to remove (i.e., "trip out") the drillstring from the well and it becomes necessary to pump additional drilling mud (or increase the supply pressure) through the drillstring to displace and support the volume of the drillstring retreating from the wellbore to maintain the well's hydraulic balance. By pumping additional fluids as the drillstring is tripped out of the hole, a localized region of low pressure near or below the retreating drill bit and drill pipe (i.e., suction) may be reduced and any force required to remove the drillstring may be minimized. In a conventional arrangement, the excess supply drilling mud may be pumped through the same connection, between the top-drive and drillstring, as used when drilling.

As the drillstring is removed from the well, successive sections of the retrieved drillstring are disconnected from the remaining drillstring (and the top-drive assembly) and stored for use when the drillstring is tripped back into the wellbore. Following the removal of each joint (or series of joints) from the drillstring, a new connection must be established between the top-drive and the remaining drillstring. However, breaking and re-making these threaded connections, two for every section of drillstring removed, is very time consuming and may slow down the process of tripping out the drillstring.

Previous attempts have been made at speeding up the process of tripping-out. GB2156402A discloses methods for controlling the rate of withdrawal and the drilling mud pressure to maximize the speed of tripping-out the drillstring. However, the amount of time spent connecting and disconnecting each section of the drillstring to and from the top-drive is not addressed.

Another mechanism by which the tripping out process may be sped up is to remove several joints at a time (e.g., remove several joints together as a "stand"), as discussed in GB2156402A. By removing several joints at once in a stand (and not breaking connections between the individual joints in each stand), the total number of threaded connections that are required to be broken may be reduced by 50-67%. However, the number of joints in each stand is limited by the height of the derrick and the pipe rack of the drilling rig, and the method using stands still does not address the time spent breaking the threaded connections that must still be broken.

GB2435059A discloses a device which comprises an extending piston-rod with a bung, which may be selectively engaged within the top of the drillstring to provide a fluid tight seal between the drillstring and top-drive. This arrangement obviates the need for threading and unthreading the drillstring to the top-drive. However, a problem with the device disclosed therein is that the extension of the piston-rod is dependent upon the pressure and flow of the drilling mud through the top-drive. Whilst this may be advantageous in certain applications, a greater degree of control over the piston-rod extension independent of the drilling mud pressure is desirable.

Similarly, there may be applications where it is desirable to displace fluid from the borehole, particularly, for example, when lowering the drillstring (or a casing-string) in deepwater drilling applications. In such deepwater applications, the seabed accommodates equipment to support the construction of the well and the casing used to line the wellbore may be hung and placed from the seabed. In such a configuration, a drillstring (from the surface vessel) may be used as the mechanism to convey and land the casing string into position. As the drillstring is lowered, successive sections of drillstring would need to be added to lower the drillstring (and attached casing string) further. However, as the bore of the typical drillstring is much smaller than the bore of a typical string of casing, fluid displaced by the casing string will flow up and exit through the smaller-bore drillstring, at increased pressure and flow rates. As such, designs such as those disclosed in GB2435059A would not allow reverse flow of drilling mud (or seawater) as would be required in such a casing installation operation.

Embodiments of the present disclosure seek to address these and other issues of the prior art.

SUMMARY OF THE CLAIMED SUBJECT MATTER

In one aspect, the present disclosure relates to a tool to direct a fluids from a lifting assembly and a bore of a downhole tubular. The tool may include an engagement assembly configured to selectively extend and retract a seal assembly disposed at a distal end of the tool into and from a proximal end of the downhole tubular and a valve assembly operable between an open position and a closed position, wherein the valve assembly is configured to allow fluids from the lifting assembly to enter the downhole tubular through the seal assembly when in the closed position and wherein the valve assembly is configured to allow fluids from the downhole tubular to be diverted from the lifting assembly when in the open position.

In another aspect, the present disclosure relates to a method to direct fluids from a lifting assembly and a bore of a downhole tubular including providing a communication tool to a distal end of the lifting assembly, the communication tool comprising an engagement assembly, a valve assembly, and a seal assembly, extending the seal assembly into the bore of the downhole tubular with the engagement assembly, pumping fluids from the lifting assembly, through the communication tool, and into the downhole tubular, opening the valve assembly to divert fluids flowing in reverse from the downhole tubular to a bypass port, and retracting the seal assembly from the bore of the downhole tubular with the engagement assembly.

In another aspect, the present disclosure relates to a valve assembly to direct fluids from a lifting assembly and a downhole tubular. The valve assembly may include a shuttle valve piston operable to block a bypass port in a first position and to reveal the bypass port in a second position, a seal cap extending from an end of the shuttle valve piston, a secondary piston disposed about the end of the shuttle valve piston, and a one-way valve configured to block fluids from the downhole tubular from flowing into the lifting assembly, wherein the shuttle valve piston is configured to be thrust into the first position by the fluids from the lifting assembly acting upon the seal cap, wherein the shuttle valve piston is configured to be thrust into the second position by the fluids from the downhole tubular acting upon the one-way valve, wherein the secondary piston is biased to seal against the seal cap to block flow of the fluids from the lifting assembly from the downhole tubular, and wherein the secondary piston is configured to be thrust away from the seal cap by the fluids from the lifting assembly when the shuttle valve piston is in the first position.

BRIEF DESCRIPTION OF DRAWINGS

Features of the present disclosure will become more apparent from the following description in conjunction with the accompanying drawings.

DETAILED DESCRIPTION

Select embodiments describe a tool to direct fluids from a top-drive (or other lifting) assembly and a bore of a downhole tubular. In particular, the tool may include an engagement assembly to extend a seal assembly into the bore of the downhole tubular and a valve assembly to selectively allow pressurized fluids from the top-drive assembly to enter the downhole tubular, but divert pressurized fluids from the downhole tubular away from the top-drive assembly.

More particularly, in certain embodiments, the valve assembly may include a shuttle valve piston comprising a seal cap and a one-way valve, and a secondary piston disposed about the shuttle valve piston to seal against the seal cap. As such, in select embodiments, the shuttle valve piston may operate between an open and a closed position, such that the pressurized fluids from the downhole tubular are diverted when the shuttle valve piston is in the open position and the pressurized fluids from the top-drive assembly are able to flow to the downhole tubular when the shuttle valve piston is in the closed position. Further, the secondary piston may operate to allow the fluids from the top-drive assembly to flow to the downhole tubular when the a differential pressure between the top-drive assembly and the downhole tubular exceeds an activation threshold.

Figure 1A:
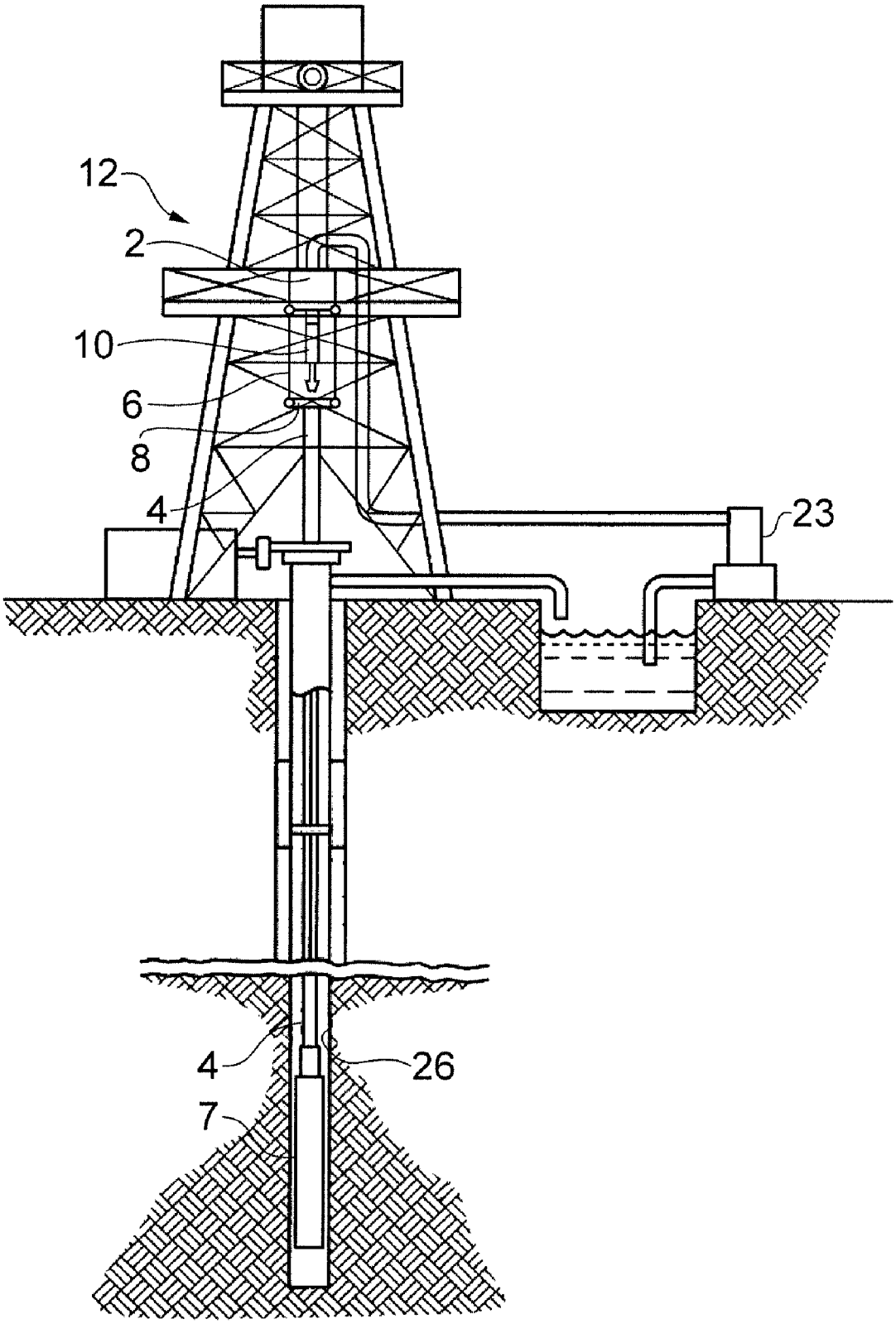
FIGS. 1*a* and 1*b* schematically depict a connector in accordance with embodiments of the present disclosure and depicts the connector in position between a top-drive and a downhole tubular.
Figure 1B:
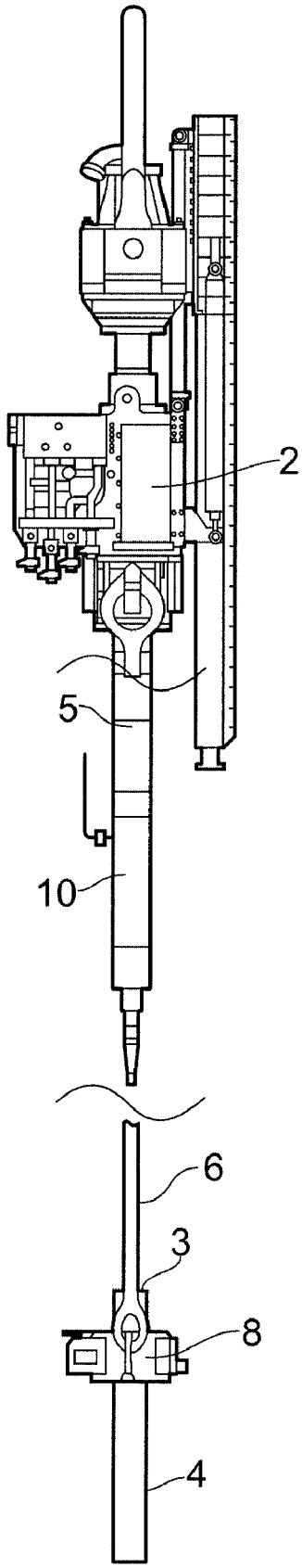

Referring initially to FIGS. 1*a* and 1*b* (collectively referred to as "FIG. 1"), a top-drive assembly 2 is shown connected to a proximal end of a string of downhole tubulars 4. As shown, top-drive 2 may be capable of raising ("tripping out") or lowering ("tripping in") downhole tubulars 4 through a pair of lifting bales 6, each connected between lifting ears of top-drive 2, and lifting ears of a set of elevators 8. When closed (as shown), elevators 8 grip downhole tubulars 4 and prevent the string from sliding further into a wellbore 26 (below).

Thus, the movement of string of downhole tubulars 4 relative to the wellbore 26 may be restricted to the upward or downward movement of top-drive 2. While top-drive 2 (as shown) must supply any upward force to lift downhole tubular 4, downward force is sufficiently supplied by the accumulated weight of the entire free-hanging string of downhole tubulars 4, offset by their accumulated buoyancy forces of the downhole tubulars 4 in the fluids contained within the wellbore 26. Thus, as shown, the top-drive assembly 2, lifting bales 6, and elevators 8 must be capable of lifting (and holding) the entire free weight of the string of downhole tubulars 4.

As shown, string of downhole tubulars 4 may be constructed as a string of threadably connected drill pipes (e.g., a drillstring 4), may be a string of threadably connected casing segments (e.g., a casing string 7), or any other length of generally tubular (or cylindrical) members to be suspended from a rig derrick 12. In a conventional drillstring or casing string, the uppermost section (i.e., the "top" joint) of the string of downhole tubulars 4 may include a female-threaded "box" connection 3. In some applications, the uppermost box connection 3 is configured to engage a corresponding male-threaded ("pin") connector 5 at a distal end of the top-drive assembly 2 so that drilling-mud or any other fluid (e.g., cement, fracturing fluid, water, etc.) may be pumped through top-drive 2 to bore of downhole tubulars 4. As the downhole tubular 4 is lowered into a well, the uppermost section of downhole tubular 4 must be disconnected from top-drive 2 before a next joint of string of downhole tubulars 4 may be threadably added.

As would be understood by those having ordinary skill, the process by which threaded connections between top-drive 2 and downhole tubular 4 are broken and/or made-up may be time consuming, especially in the context of lowering an entire string (i.e., several hundred joints) of downhole tubulars 4, section-by-section, to a location below the seabed in a deepwater drilling operation. The present disclosure therefore relates to alternative apparatus and methods to establish the connection between the top-drive assembly 2 and the string of downhole tubulars 4 being engaged or withdrawn to and from the wellbore. Embodiments disclosed herein enable the fluid connection between the top-drive 2 (in communication with a mud pump 23 and the string of downhole tubulars 4 to be made using a hydraulic connector tool 10 located between top-drive assembly 2 and the top joint of string of downhole tubulars 4.

However, it should be understood that while a top-drive assembly 2 is shown in conjunction with hydraulic connector 10, in certain embodiments, other types of "lifting assemblies" may be used with hydraulic connector 10 instead. For example, when "running" casing or drill pipe (i.e., downhole tubulars 4) on drilling rigs (e.g., 12) not equipped with a top-drive assembly 2, hydraulic connector 10, elevator 8, and lifting bales 6 may be connected directly to a hook or other lifting mechanism to raise and/or lower the string of downhole tubulars 4 while hydraulically connected to a pressurized fluid source (e.g., a mud pump, a rotating swivel, an IBOP, a TIW valve, an upper length of tubular, etc.). Further still, while some drilling rigs may be equipped with a top-drive assembly 2, the lifting capacity of the lifting ears (or other components) of the top-drive 2 may be insufficient to lift the entire length of string of downhole tubular 4. In particular, for extremely long or heavy-walled tubulars 4, the hook and lifting block of the drilling rig may offer significantly more lifting capacity than the top-drive assembly 4.

Therefore, throughout the present disclosure, where connections between hydraulic connector 10 and top-drive assembly 2 are described, various alternative connections between the hydraulic connector and other, non-top-drive lifting (and fluid communication) components are contemplated as well. Similarly, throughout the present disclosure, where fluid connections between hydraulic connector 10 and top-drive assembly 2 are described, various fluid and/or lifting arrangements are contemplated as well. In particular, while fluids may not physically flow through a particular lifting assembly lifting hydraulic connector 10 and into tubular, fluids may flow through a conduit (e.g., hose, flex-line, pipe, etc) used alongside and in conjunction with the lifting assembly and into hydraulic connector 10.

Figure 2A:
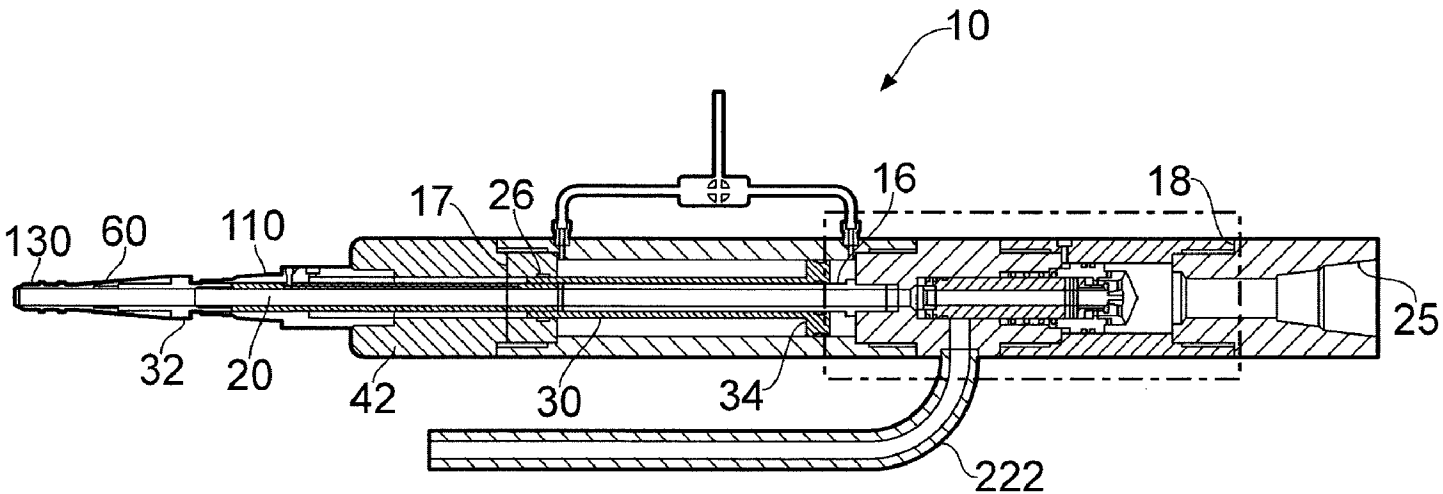
FIGS. 2*a* and 2*b* are sectional side projections of the connector according to embodiments of the present disclosure and show the connector in a retracted position (FIG. 2*a*) and in an extended position (FIG. 2*b*).
Figure 2B:
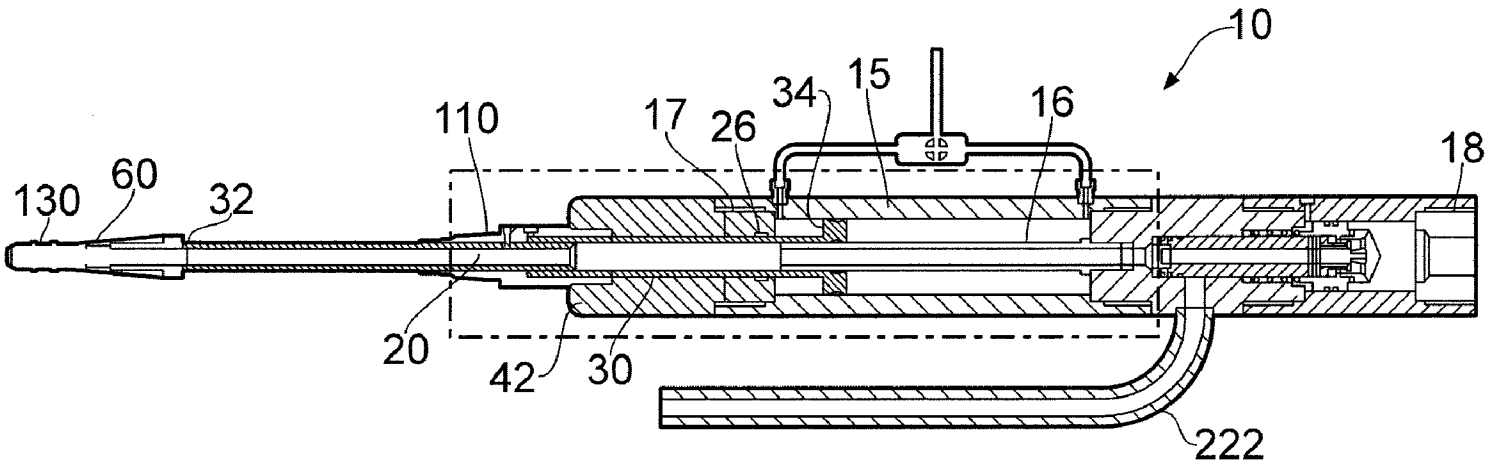

Referring now to FIGS. 2*a* and 2*b* (collectively referred to as "FIG. 2"), a hydraulic connector 10 in accordance with certain embodiments of the present disclosure is shown. Hydraulic connector 10 includes an engagement assembly including a main or primary cylinder 15 and a piston-rod assembly 20 slidably engaged and configured to reciprocate within cylinder 15. As shown, piston-rod assembly 20 includes a hollow tubular rod 30 configured to be slidably engagable within cylinder 15 so that a first (i.e., lower) end 32 of tubular rod 30 protrudes outside a distal end of cylinder 15 and a second (i.e., upper) end 34 is contained within cylinder 15. Tubular rod 30 is also shown disposed about a hollow shaft 16 disposed within cylinder 15. Tubular rod 30, cylinder 15, and shaft 16 are arranged such that their longitudinal axes are coincident and tubular rod 30 is slidably disposed about shaft 16 such that piston-rod assembly 20 telescopically extends through the cylinder 15 from a retracted position (FIG. 2*a*) to an extended position (FIG. 2*b*).

Referring still to FIG. 2, a bung 60 and seals (e.g., cup seals) 130 are shown located on first end 32 of the tubular 30. In certain embodiments, bung 60 may be made from a resilient and/or elastomeric material (e.g., rubber, nylon, polyethylene, silicone, etc.) and may be shaped to fit into a top end (e.g., box 3) of string of downhole tubulars 4. In select embodiments, bung 60 and seals 130 may be configured to engage the top end of string of downhole tubulars 4 when piston-rod assembly 20 is in its extended (FIG. 2*b*) position, thereby providing a fluid tight seal between hydraulic connector 10 (and top-drive assembly 2) and string of downhole tubulars 4. Thus, in select embodiments, hydraulic connector 10 may include a seal assembly including tubular rod 30, bung 60, and seals 130 such that seals 130 effectuate a seal between an inner bore of downhole tubular 4 and an outer profile of tubular rod 30. Therefore, in select embodiments, bung 60 and/or seals 130 may seal on, in, or around box 3 in the top joint of string of downhole tubulars 4.

At a first, distal end 17, cylinder 15 may include a first end plug 42, through which the tubular rod 30 is able to reciprocate. As shown, first end plug 42 may be configured to be threaded into distal end 17 of cylinder 15, although those having ordinary skill will appreciate that other connection mechanisms may be used. An additional threaded (or otherwise connected) member 110 may be provided on a distal end of first end plug 42. Threaded member 110 may be connected to first end plug 42 by virtue of a threaded connection and threaded member 110 includes a passage and a bore to allow tubular rod 30 to pass therethrough as hydraulic connector 10 reciprocates between extended retracted positions. In select embodiments, threaded member 110 is configured to seal the inside of cylinder 15 from outside and to allow tubular rod 30 to slide in or out of the cylinder 15. As would be understood by those having ordinary skill, seals (e.g., o-rings) 26 may be used to seal between first end plug 42 and tubular rod 30.

At the opposite (or proximal) end 18 of cylinder 15, a threaded connection 25 is provided for engagement with top-drive assembly 2. As shown, threaded connection 25 may include a standard threaded female box connection which may be configured to threadably engage a corresponding pin thread of top-drive assembly 2. Therefore, as shown, top-drive assembly 2 may provide drilling fluid to cylinder 15 through threaded connection 25.

Figure 3A:
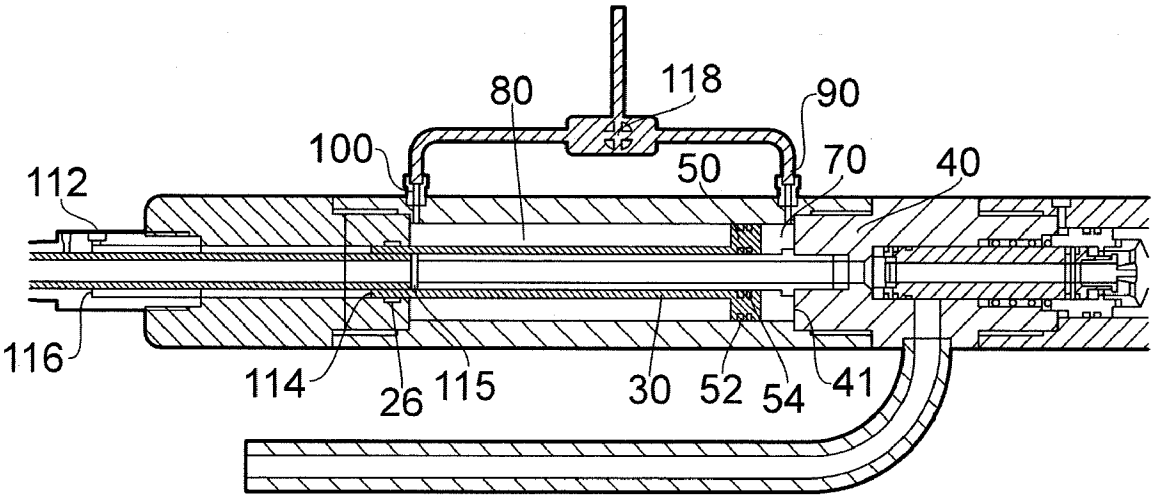
FIGS. 3*a* and 3*b* are sectional side projections of the connector according to embodiments of the present disclosure and show the detail of the arrangement for extending and retracting the connector.
Figure 3B:
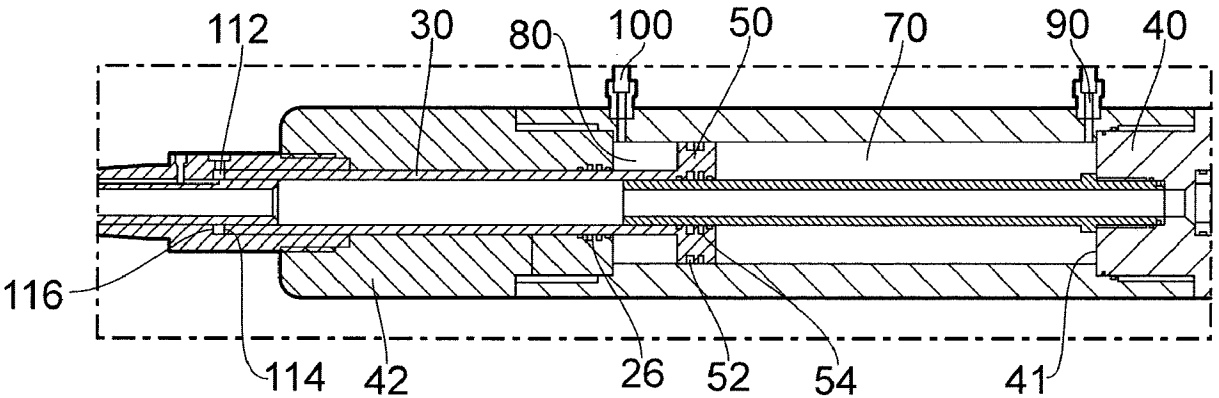

Referring now to FIGS. 3*a* and 3*b* (collectively referred to as "FIG. 3"), piston-rod assembly 20 includes a piston 50 disposed at second end 34 of the tubular rod 30. Piston 50 is rigidly mounted to tubular rod 30 and is therefore sable to reciprocate inside the cylinder 15 between a second end plug 40 and first end plug 42. As shown, second end plug 40 may be threaded into (or otherwise coupled to) cylinder 15 and threaded onto (or otherwise coupled to) shaft 16. As shown, second end plug 40 is configured such that the bore of shaft 16 extends through and communicates with a bore of second end plug 40.

As such, piston 50 divides cylinder 15 into two chambers, a first (lower) chamber 80 and a second (upper) chamber 70. As shown, first chamber 80 is defined by an upper face of first end plug 42, an inner diameter of cylinder 15, an outer diameter of tubular rod 30 and a lower face of piston 50. Similarly, second chamber 70, is defined by an lower face 41 of second end plug 40, the inner diameter of cylinder 15, an outer diameter of shaft 16, and an upper face of piston 50. As shown, piston 50, fixedly attached to tubular rod 30, may be sealed against the inner diameter of cylinder 15 and the outer diameter of shaft 16 by known sealing mechanisms 52 and 54, including, but not limited to, o-ring seals, to fluids from communicating between first and second chambers 80 and 70. While cylinder 15, shaft 16, tubular rod 30, and piston 50 are all shown and described as cylindrical (and therefore having diameters), one of ordinary skill in the art will appreciate that other, non-circular geometries may also be used without departing from the scope of the present disclosure.

Referring to FIGS. 2 and 3 together, retraction of the piston-rod assembly 20 may be limited by bung 60 abutting against threaded member 110 in the fully retracted position (FIG. 2*a*) and the extension of piston-rod assembly 20 may be limited by abutment of a first annular shoulder 114 of tubular rod 30 with a second annular shoulder 116 of threaded member 110 in the fully extended position (FIG. 2*b*). As shown, first annular shoulder 114, second annular shoulder 116, bung 60, and threaded member 110 may be configured to act as mechanical stops for the movement of piston-rod assembly 20 within cylinder 15. Furthermore, an atmospheric vent 112 may be provided in threaded member 110 between first annular shoulder 114 and second annular shoulder 116 to prevent air trapped therebetween does not restrict movement of tubular rod 30. Retraction of piston-rod assembly 20 may also be limited by a third annular shoulder 115, which may be located inside piston-rod assembly 20, such that third annular shoulder 115 abuts a lower end of shaft 16. Furthermore, to avoid pressure lock, the volume of fluid displaced by the movement of third annular shoulder 115 may be equal to the volume of fluid displaced by piston-rod assembly 20 as it extends into string of downhole tubulars 4.

In a first exemplary embodiment, the first and second chambers 80 and 70 may be supplied with pressurized air from a pressurized air supply (not shown). First chamber 80 may be in fluid communication with the air supply via a first supply port 100 and second chamber 70 may be in fluid communication with the air supply via a second supply port 90. In select embodiments, a valve 118 (shown in FIG. 3*a*) may be provided between first and second supply ports 100, 90 and selectively connected to the air supply and the atmosphere. In certain embodiments, valve 118 may include a four-way cross port valve to selectively connect the first and second supply ports 100, 90 to the air supply and the second and first supply ports 90, 100 respectively to the atmosphere. Alternatively, first and second chambers 80, 70 may be pressurized with a working fluid other than air and the valve 118 may comprise other valving mechanisms. In certain embodiments, valve 118 may comprise shear or solenoid valves configured to alternately supply high and low-pressure hydraulic fluids to first and second chambers 80, 70.

Thus, in certain embodiments, the air (or other fluid) supply may selectively provide pressurized fluid to one of the first 80 and the second chamber 70 via valve 118, while the other of the first 80 and second 70 chambers is vented to the atmosphere or a low-pressure fluid supply. Thus, a pressure differential may be created across second piston 50 and piston-rod assembly 20 may extend when the force acting on piston 50 due to pressure in first chamber 80 is higher than the force acting on piston 50 due to pressure in second chamber 70 (FIG. 3*b*). Conversely, piston-rod assembly 20 may retract when the force acting on piston 50 due to pressure in second chamber 70 is higher than the force acting on the second piston 50 due to the air pressure in the first chamber 70 (FIG. 3*a*).

Figure 4A:
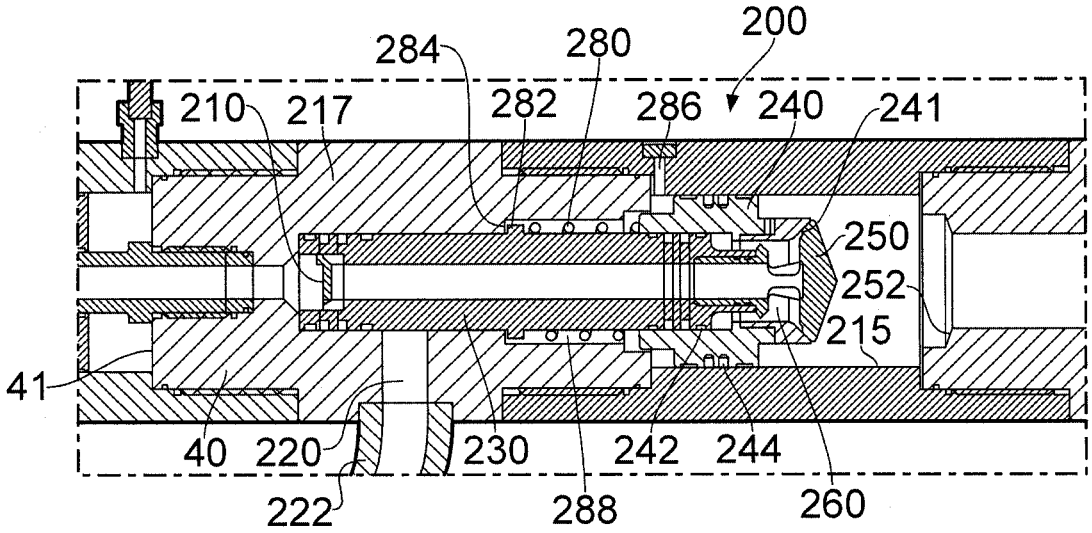
FIGS. 4*a*, 4*b* and 4*c* are a more detailed sectional view of the connector according to embodiments of the present disclosure and show the arrangement for selectively transferring the drilling fluid from the downhole tubular or an outlet.
Figure 4B:
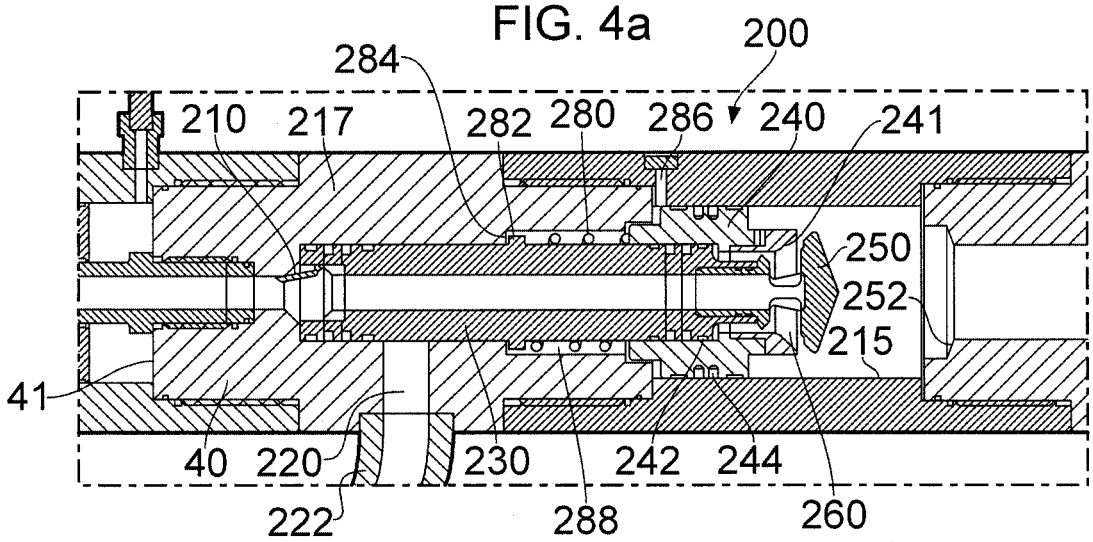
Figure 4C:
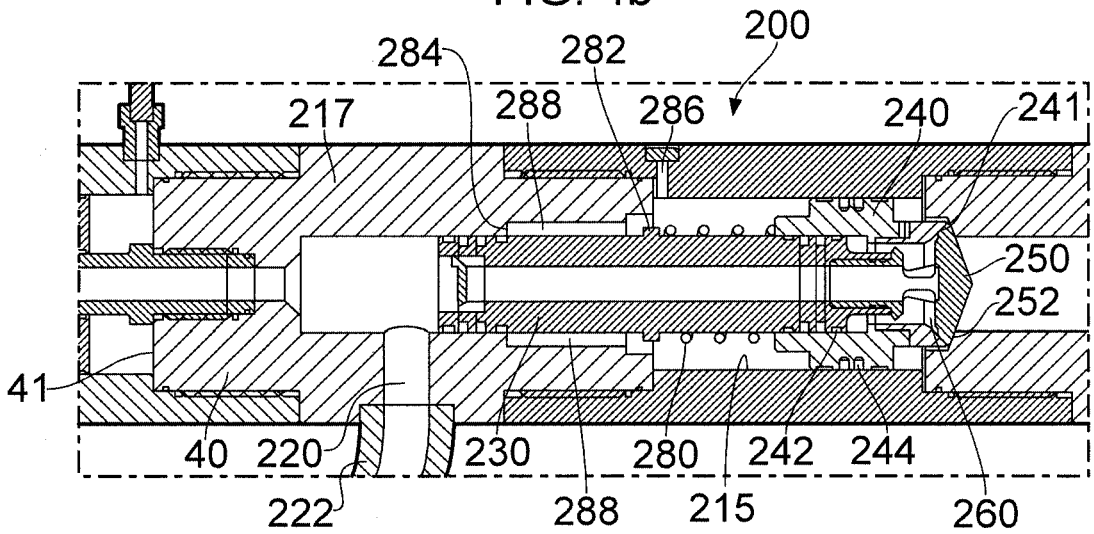

Referring now to FIGS. 4*a*, 4*b*, and 4*c* (collectively referred to as "FIG. 4"), a valve assembly 200 of cylinder 15 is shown. While a particular configuration of a poppet valve is shown for valve assembly 200 in FIG. 4, it should be understood that other types of valves may be used with hydraulic connector 10 without departing from the claimed subject matter. As shown, valve assembly 200 may be disposed within cylinder 15 and located between threaded connection 25 (shown in FIG. 2) and end face 41 of second end plug 40 and at an opposite side of end face 41 from shaft 16 and tubular rod 30. Valve assembly 200 may include a shuttle valve piston 230 that may be slidable with respect to second end plug 40. A port 220 may be provided in a sidewall of second end plug 40, port 220 providing an outlet to a reservoir for drilling fluid via a pipe 222. Port 220 may be located in a section of second end plug 40 traversed by shuttle valve piston 230 so that when shuttle valve piston 230 is in a first (fully closed) position (as a shown in FIGS. 4*a* and 4*b*), port 220 may be closed by shuttle valve piston 230. Similarly, when shuttle valve piston 230 is in a second (fully open) position (as shown in FIG. 4*c*), port 220 is open to the centre of second end plug 40 and in communication with shaft 16 and tubular rod 30. Thus, when shuttle valve piston 230 is in the open position, port 220 may be in fluid communication with a central bore of hollow shaft 16 and tubular rod 30 connecting to second end plug 40. Furthermore, shuttle valve piston 230 may include a hollow section to allow fluid communication from threaded connection 25 to the central bore of shaft 16, the central bore of tubular 30, and a bore of string of downhole tubulars 4.

As shown in FIG. 4, shuttle valve piston 230 may include a one-way flow valve 210 disposed at a first (distal) end of shuttle valve piston 230 adjacent to second end plug 40. One-way flow valve 210 may be configured to allow fluids to flow from threaded connection 25 to shaft 16, but not in reverse. In certain embodiments, one-way flow valve 210 may be a flapper valve configured to engage a seat, but those having ordinary skill will appreciate that one-way flow valve 210 may be of any other "check valve" configuration, including, but not limited to, ball or plug socket arrangements.

Additionally, valve assembly 200 may include a secondary piston 240 slidably disposed about a second end of shuttle valve piston 230 and adjacent to threaded connection 25. A fluid tight seal may be provided between secondary piston 240 and shuttle piston 230, and secondary piston 240 and a tubular member 215 (i.e., a cylinder) by virtue of seals 242 and 244 respectively. Shuttle valve piston 230 may also include an opening 260 in a second (proximal) end of shuttle valve piston 230. As shown in FIGS. 4*a* and 4*c*, opening 260 may be blocked by engagement of a seal surface 241 at a proximal end of secondary piston 240 with a cap 250 disposed at second end of shuttle valve piston 230. However, opening 260 may be open when secondary piston 240 is positioned as shown in FIG. 4*b* so that the central bore of shuttle valve piston 230 may be in fluid communication with threaded connection 25.

As described above, shuttle valve piston 230 may include a cap 250 provided on a second end of shuttle valve piston 230. As shown in FIGS. 4*a* and 4*c*, secondary piston 240 may abut cap 250 when secondary piston 240 is in a first position. Thus, cap 250 may prevent secondary piston 240 from extending beyond the second end of the shuttle valve piston 230. Additionally, cap 250 may be substantially conically shaped to allow it to direct a flow of fluid around cap 250 and into opening 260 when secondary piston 240 is in a second position (FIG. 4*b*). Furthermore, cap 250 may also limit movement of the shuttle valve piston 230. In particular, referring briefly to FIG. 4*c*, when shuttle valve piston 230 is in a second position, cap 250 may abut a recess 252 in threaded connection 25. Furthermore, a projected area of cap 250 exposed to flow from threaded connection 25 may be greater than a projected area of secondary piston 240 exposed to the flow from threaded connection 25.

The motion of secondary piston 240 relative to shuttle valve piston 230 may be biased towards the first position (FIGS. 4*a* and 4*c*) of secondary piston 240 by a spring 280. A first end of spring 280 abuts secondary piston 240 and a second end of spring 280 abuts an abutment 282 of shuttle valve piston 230. Abutment 282 may also provide a mechanism to limit the motion of shuttle valve piston 230, as abutment 282 abuts a shoulder 284 of a tubular member 217 when shuttle valve piston 230 is in its first position (shown in FIGS. 4*a* and 4*b*). Spring 280 may occupy a cavity 288 formed by shoulder 284, tubular member 217, secondary piston 240, and shuttle valve piston 230. A vent 286 to the cavity 288 may be provided in a sidewall of tubular member 217 as the volume of cavity 288 may change as shuttle valve piston 230 moves between its first and second positions. In an alternative embodiment, spring 280 may include a pneumatic or hydraulic piston arrangement, which may be achieved by closing vent 286.

Figure 5A:
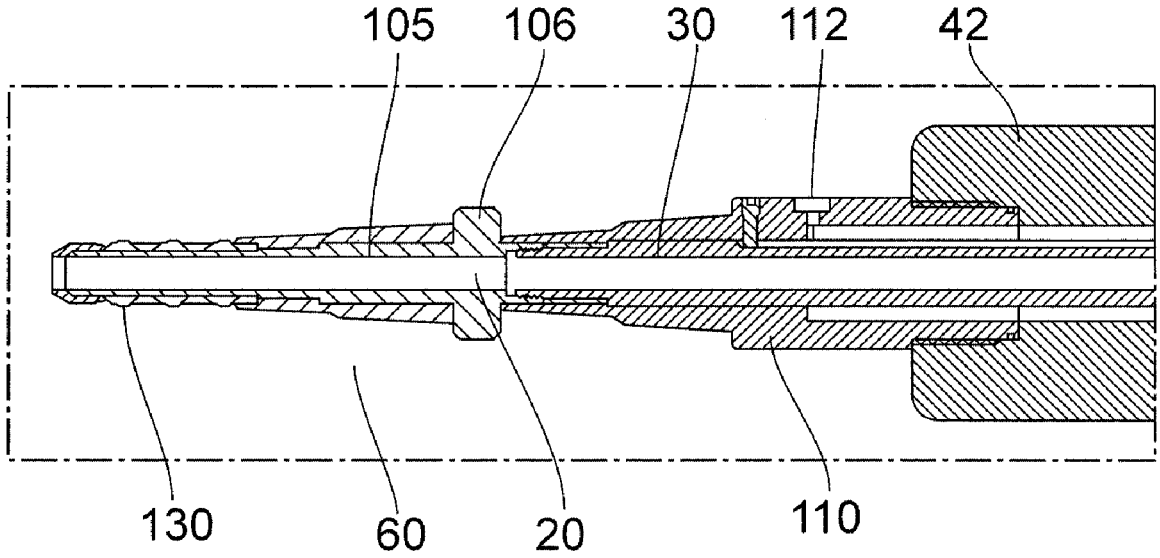
FIGS. 5*a* and 5*b* are more detailed sectional views of the connector according to embodiments of the present disclosure and show the connector in a retracted position (FIG. 5*a*) and a concealed position (FIG. 5*b*).

Referring now to FIG. 5*a*, bung 60 and hydraulic connector 10 may comprise a detachable shaft 105. Detachable shaft 105 may be threadably attached to tubular rod 30 and may therefore be selectively detachable from tubular rod 30. Additionally, seals 130 may be provided around an outer profile of detachable shaft 105. Detachable shaft 105 may be hollow to accommodate fluids flowing from top-drive assembly 2, through shaft 16, through tubular rod 30, and into downhole tubular 4.

In certain embodiments, detachable shaft 105 and attached seals 130 may be interchangeable with alternative shaft and seal configurations. In select embodiments, interchangeable configurations may facilitate repair and replacement of worn seals 130. Further, interchangeable configurations may allow for bungs 60 of different shapes and configurations to be deployed for different configurations of downhole tubulars (e.g., 4 of FIG. 1). Furthermore, in certain embodiments, a connection between tubular rod 30 and detachable shaft 105 may be constructed to act as a sacrificial connection. In such embodiments, if an impact load is applied to bung 60, the connection may fail, so that piston-rod assembly 20, cylinder 15, and remainder of hydraulic connector 10 may be protected from damage. For example, detachable shaft 105 may be provided with a female-threaded socket configured to engage a corresponding male thread of tubular rod 30. As such, the female thread of detachable shaft 105 may be deliberately weakened, for example, at its root, so that it may fail before damage occurs to tubular rod 30.

In select embodiments, the end of the detachable shaft 105 attached to tubular rod 30, may have similar (or smaller) external dimensions as tubular rod 30 to ensure that detachable shaft 105 may fit inside threaded member 110. Furthermore, in certain embodiments, detachable shaft 105 may include a protrusion 106 to act as a mechanical stop and limit the retraction of the piston-rod assembly 20 into the cylinder 15. Protrusion 106 may also include spanner flats so that detachable shaft 105 may be removed from the tubular rod 30.

Figure 5B:
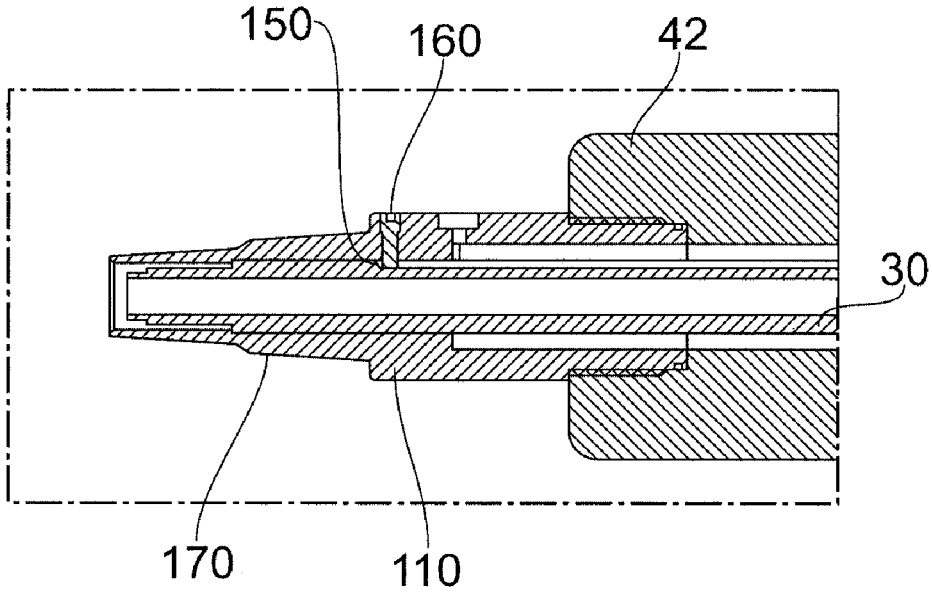

Referring now to FIG. 5*b*, tubular rod 30 is shown further including an abutment shoulder 150. In certain embodiments, abutment shoulder 150 may be formed as a flat portion on the outer surface of tubular rod 30 adjacent to a cylindrical portion. Abutment shoulder 150 may provide a keyway configured to receive a corresponding key 160 of threaded member 110. Key 160 may engage the keyway of abutment shoulder 150 so that rotation of the tubular rod 30 relative to threaded member 110 is prevented, thereby facilitating removal of detachable shaft 105. Furthermore, tubular rod 30 may be fully retracted within threaded member 110 when detachable shaft 105 is removed, such that tubular rod 30 does not extend beyond the end of threaded member 110. Key 160 and keyway may also mechanically limit the retraction of the piston-rod assembly 20 when detachable shaft 105 is removed.

Additionally, threaded member 110 may optionally include a threaded section 170. In select embodiments, threaded section 170 may threadably connect to an open end of downhole tubular 4 so that hydraulic connector 10 may transmit torque from top-drive assembly 2 to downhole tubular 4. Accordingly, in order to transmit torque, threaded connections between top-drive assembly 2, threaded connection 25, threaded member 110, and downhole tubular 4 should be selected that the make-up and break-out directions are the same.

Detachable shaft 105 (and therefore bung 60) may be removed from the tubular rod 30 when threaded member 110 is connected (directly) to downhole tubular 4. Tubular rod 30 may be sized so that it fits inside the interior of downhole tubular 4 beyond a threaded portion of an open end of downhole tubular 4. Alternatively, tubular rod 30 may be retracted into threaded member 110.

In an alternative embodiment, detachable shaft 105 need not be removed from tubular rod 30 when threaded member 110 is attached directly to downhole tubular 4. Hydraulic connector 10 may be connected to downhole tubular 4 by both bung 60 and threaded member 110. As such, the alternative embodiment may allow rapid connection of hydraulic connector 10 between a downhole tubular 4 and a top-drive assembly 2 without having to remove the detachable shaft 105, thereby saving time and money. To engage threaded member 110 with downhole tubular 4 without removing detachable shaft 105, protrusion 106 may be constructed smaller than shown in FIG. 3*a* so that it does not radially extend beyond the outer surface of bung 60.

Additionally, threaded member 110 may be removable from first end cap 42 and may therefore be interchangeable with alternative threaded members. This interchangeability may facilitate repair of the threaded member 110 and may also enable differently-shaped threaded members (110) to be configured for use with a particular downhole tubular 4.

In operation, hydraulic connector 10 may be connected to top-drive drilling assembly 2 as it is lowered to a suitable position so that hydraulic connector 10 may reach an open end of the downhole tubular 4. Once top-drive assembly 2 and hydraulic connector 10 are in place, piston-rod assembly 20 may be extended by increasing the pressure in second chamber 70. Bung 60 may then be engaged within the upper (box) end of downhole tubular 4 and a fluid-tight seal is provided by seals 130. Elevators 8 may then engage downhole tubular 4 and a set of slips holding downhole tubular string 4 at the rig floor (not shown) may be released. Downhole tubular 4 may then be lifted from or lowered into the well. Additionally, as downhole tubular 4 is lifted, drilling fluid may continue to be pumped through top-drive drilling assembly 2, through hydraulic connector 10, and into downhole tubular 4. As such, hydraulic fluid may continue to be pumped downhole to replace the volume of downhole tubular 4 removed from the wellbore as it is raised. Thus a "suction" zone of low pressure that might otherwise damage the wellbore (or increase the lifting force of string of downhole tubulars 4) may be eliminated.

Thus, top-drive drilling assembly 2 may pump fluid through hydraulic connector 10. The pressure of the fluid may act on cap 250 and secondary piston 240 such that shuttle valve piston 230 may be moved from its second (uppermost) position towards its first (downward) position. Secondary piston 240 remains in its first (uppermost) position relative to the shuttle, as the projected area (i.e., the area acted upon by pressurized fluid) of cap 250 is greater than the projected area of secondary piston 240. Movement of shuttle valve piston 230 stops in the first position (shown in FIG. 4*a*) once abutment 282 of shuttle valve piston 230 engages notch 284.

With shuttle valve piston 230 located in the first position, the pressure of the fluid may then force secondary piston 240 to move (downward) relative to shuttle valve piston 230. Secondary piston 240 may be forced downward when a pressure of fluids from the top-drive assembly minus a pressure of wellbore fluids exceeds an activation threshold. As secondary piston 240 moves downward into its second position (shown in FIG. 4*b*), opening 260 in the shuttle valve 230 is revealed and fluid may flow through the passageway through shuttle valve 230, one-way flow valve 210, and into the passage extending through shaft 16. The fluid may then flow into extended tubular rod 30 and into downhole tubular 4 where it may be delivered downhole to replace the volume of downhole tubular 4 as it is retracted from the well. Throughout this process the fluid may be kept separate from the air (or other working fluid) in first and second chambers 80, 70, by virtue of end-plug 40, shaft 16, tubular rod 30 and various seals 26, 52, 54, etc.

If a build up of fluid pressure results from an excess of fluid in the wellbore, a blockage, or through lowering of downhole tubular 4, then fluid may flow back through the piston-rod assembly 20, shaft 16, and second end plug 40 towards the shuttle valve piston 230. However, once this reverse flow reaches one-way flow valve 210, the reverse flow is stopped and prevented from reaching shuttle valve piston 230. As such, one-way flow valve 210 creates a projected (piston) area and shuttle valve piston 230 may be reversed into its second (uppermost) position if the pressure of wellbore fluids minus the pressure of fluids from the top-drive assembly exceeds an opening threshold. In the second position of shuttle valve piston 230, port 220 is revealed (shown in FIG. 4*c*) and the reversing flow from downhole tubular 4 may continue through the port outlet and piping 222 to a reservoir. Once the pressure in downhole tubular 4 is reduced, shuttle valve piston 230 may return to its first position, closing the port 220, and operate normally (i.e., allowing fluid to flow from top-drive assembly 2 to downhole tubular 4), as described above. Shuttle valve piston 230 may return to the first (closed) position when the fluid pressure from the top-drive assembly minus the fluid pressure from the wellbore below exceeds a closing threshold.

When a section of downhole tubular 4 is clear of the well (one or more sections may be removed at a time), the slips may be reengaged with downhole tubular 4 and the flow of fluid from the top-drive assembly 2 may be stopped. With flow of fluid from top-drive assembly 2 stopped, secondary piston 240 will return its first (uppermost) position under the action of biasing spring 280 and shut off opening 260 and the flow path to downhole tubular 4. The piston-rod assembly 20 may then be retracted from downhole tubular 4 (by increasing the pressure in the first chamber 80) without leaking fluid from top-drive assembly 2. The exposed section of the downhole tubular 4 may then be removed from the rest of the string of downhole tubulars 4 remaining in the well and the process described above may be repeated.

As previously mentioned, hydraulic connector 10 may replace a traditional threaded connection between top-drive drilling assembly 2 and a string of downhole tubulars as the string is tripped out or tripped into the well. With hydraulic connector 10, a connection between top-drive drilling assembly 2 and downhole tubular 4 may be established in a much shorter time and at great cost savings.

Figure 6:
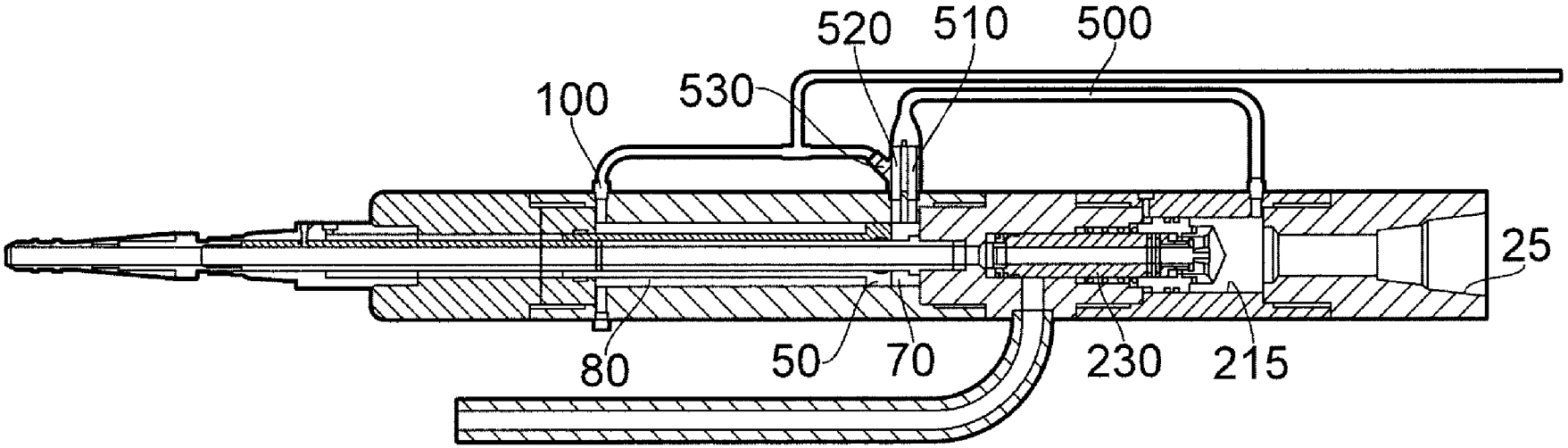
FIG. 6 is a sectional side projection of the connector according to a first alternative embodiment of the present disclosure.

Referring now to FIG. 6, an alternative embodiment of second chamber 70 is shown communicating with fluid via a bypass pipe 500. As shown, bypass pipe 500 includes a large through-bore hydraulic link joining a section of the cylinder 215 between the shuttle valve piston 230 and threaded connection 25 to second chamber 70. A second one-way flow valve 510 may be provided in bypass pipe 500 to permit fluid flow into second chamber 70 (from cylinder 215), but not in the reverse direction. In addition to second one-way flow valve 510, a release valve 520 may positioned parallel with second one-way flow valve 510 and also in fluid communication with second chamber 70 and bypass pipe 500.

However, release valve 520 may be configured to permit flow from second chamber 70 to bypass pipe 500 when a sufficient pressure (i.e., a pressure exceeding a pre-determined threshold) is applied to a side port 530. Side port 530 is not in fluid communication with second chamber 70 or bypass pipe 500, but instead may release valve 520 to allow fluid to flow from second chamber 70 to top-drive drilling assembly 2. As shown, side port 530 may be in fluid communication with first supply port 100. When the pressure of the air (or any other fluid) supply is increased, the air (or other fluid) in first chamber 80 acts on piston 50 causing piston-rod assembly 20 to retract. The pressurized air supply may also release valve 520 and the fluid in second chamber 70 may drain through release valve 520 and bypass pipe 500 back top-drive drilling assembly 2. When the pressure of the air supply falls below an activation level, release valve 520 reseats and fluid may again flow into second chamber 70 via second one-way valve 510. Piston-rod assembly 20 may then extend due to the pressure of the drilling fluid acting on piston 50.

Figure 7:
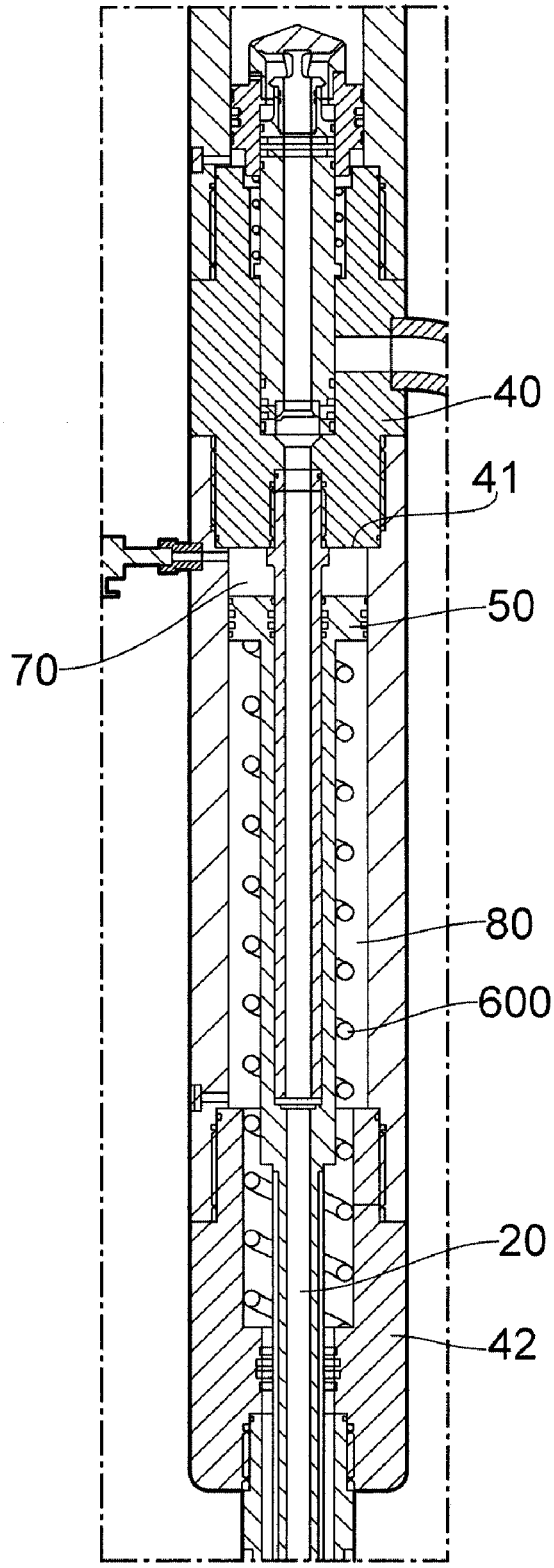
FIG. 7 is a sectional side projection of the connector according to second alternative embodiment of the disclosure.

Referring now to FIG. 7, an alternative embodiment of first chamber 80 may include a second spring 600. Second spring 600 may act against piston 50, so that piston 50 and piston-rod assembly 20 are biased towards end face 41 of second end plug 40. Pressurized air may then be selectively supplied to second chamber 70 to extend piston-rod assembly 20. To retract piston-rod assembly 20, second chamber 70 may be vented to atmospheric pressure.

In alternative embodiments, second spring 600 may be provided in second chamber 70 and piston 50 and piston-rod assembly 20 may be biased towards first end plug 42. First chamber 80 may then be selectively provided with pressurized air to retract piston-rod assembly 20.

In alternative embodiments, valve assembly 200 may be provided separately from hydraulic connector 10. In such an embodiment, valve assembly 200 may be provided to a section of downhole tubular 4 and a portion of cylinder 215 enclosing poppet valve assembly 200 may interface directly with adjacent sections of downhole tubular 4. Port 220 of valve assembly 200 in this embodiment may provide a direct outlet for fluid to the space between downhole tubular 4 and the wellbore casing. The arrangement of valve assembly 200 may otherwise be unchanged.

Further, a connection between top-drive drilling assembly 2 and downhole tubular 4 may still be established by piston-rod assembly 20, although a device separate from valve assembly 200 may provide this connection. As will be appreciated, alternative connection mechanisms known to those having ordinary skill may be used.

According to embodiments disclosed herein, valve assembly 200 may be located at any point in string of downhole tubulars 4, for example at the top of downhole tubular 4 or further down. With valve assembly 200 provided at a topmost end of the downhole tubular, valve assembly may be provided with a box connection so that it may directly receive piston-rod assembly 20 of the connection mechanism In such an arrangement, pipe 222 leading from port 220 may either deliver the backflow of drilling fluid to the space between the downhole tubular and wellbore casing or to a separate reservoir.

In alternative embodiments, valve assembly 200 may be integral to top-drive drilling assembly 4 and may be provided as a separate tool to the connection mechanism.

While the invention has been presented with respect to a limited number of embodiments, those skilled in the art, having benefit of this disclosure, will appreciate that other embodiments may be devised which do not depart from the scope of the present disclosure. Accordingly, the scope of the invention should be limited only by the attached claims.

What is claimed is:

1. A tool to direct fluids from a lifting assembly and a bore of a downhole tubular, the tool comprising:

an engagement assembly configured to selectively extend and retract a seal assembly disposed at a distal end of the tool into and from a proximal end of the downhole tubular; and a valve assembly operable between an open position and a closed position;

wherein the valve assembly is configured to allow fluids from the lifting assembly to enter the downhole tubular through the seal assembly when in the closed position;

wherein the valve assembly is configured to allow fluids from the downhole tubular to be diverted from the lifting assembly when in the open position;

wherein the valve assembly comprises a shuttle valve piston operable between a first position and a second position; and wherein the shuttle valve piston is configured to block a bypass port in the first position and the shuttle valve piston is configured to reveal the bypass port in the second position.

2. The tool of claim 1, wherein the engagement assembly comprises a piston rod assembly.

3. The tool of claim 2, wherein the piston rod assembly is operable between an extended position and a retracted position by at least one of hydraulic power and pneumatic power.

4. The tool of claim 1, wherein the seal assembly comprises a tubular rod, a bung, and a plurality of seals.

5. The tool of claim 4, wherein the plurality of seals are configured to seal between the tubular rod and the bore of the downhole tubular.

6. The tool of claim 4, wherein at least one of the bung and the plurality of seals comprises cup seals.

7. The tool of claim 4, wherein at least one of the bung and the plurality of seals is replaceable to accommodate a variety of downhole tubular sizes and configurations.

8. The tool of claim 4, wherein the fluids from the lifting assembly enter the downhole tubular through a bore of the tubular rod.

9. The tool of claim 1, wherein the shuttle valve piston is configured to be thrust into the first position when a pressure of the fluids from the lifting assembly exceeds a pressure of the fluids from the downhole tubular by a closing threshold.

10. The tool of claim 1, wherein the shuttle valve piston is configured to be thrust into the second position when a pressure of the fluids from the downhole tubular exceeds a pressure of the fluids from the lifting assembly by an opening threshold.

11. The tool of claim 1, further comprising:

a seal cap extending from an end of the shuttle valve piston;

a secondary piston disposed about the end of the shuttle valve piston; and a one-way valve of the shuttle valve piston configured to block the fluids from the downhole tubular from flowing into the lifting assembly wherein the secondary piston is biased to seal against the seal cap to block flow of the fluids from the lifting assembly from the downhole tubular;

wherein the secondary piston is configured to be thrust away from the seal cap by the fluids from the lifting assembly when the shuttle valve piston is in the first position.

12. The tool of claim 11, wherein the secondary piston is configured to be thrust away from the seal cap when a pressure of the fluids from the lifting assembly exceed a pressure of the fluids from the downhole tubular by an activation threshold.

13. The tool of claim 12, wherein the activation threshold is a function of at least an area of the seal cap, an area of the secondary piston, and an area of the one-way valve.

14. The tool of claim 1, wherein the second position of the shuttle valve piston corresponds to the open position of the valve assembly.

15. The tool of claim 1, further comprising a threaded connection at a proximal end of the tool, the threaded connection configured to engage a corresponding threaded connection of the lifting assembly.

16. The tool of claim 1, wherein the lifting assembly comprises a top-drive assembly.

17. A method to direct fluids from a lifting assembly and a bore of a downhole tubular, the method comprising:

providing a communication tool to a distal end of the lifting assembly, the communication tool comprising an engagement assembly, a valve assembly, and a seal assembly;

extending the seal assembly into the bore of the downhole tubular with the engagement assembly;

pumping fluids from the lifting assembly, through the communication tool, and into the downhole tubular;

opening the valve assembly to divert fluids flowing in reverse from the downhole tubular to a bypass port; and retracting the seal assembly from the bore of the downhole tubular with the engagement assembly.

18. The method of claim 17, further comprising retracting the seal assembly with a biasing spring.

19. The method of claim 17, further comprising applying at least one of hydraulic pressure and pneumatic pressure to the engagement assembly to retract the seal assembly.

20. The method of claim 17, further comprising applying at least one of hydraulic pressure and pneumatic pressure to the engagement assembly to extend the seal assembly.

21. The method of claim 17, further comprising thrusting a shuttle valve piston away from the bypass port with the fluids flowing in reverse to open the valve assembly.

22. The method of claim 17, further comprising displacing a secondary piston of the valve assembly to permit fluids from the lifting assembly to flow through the communication tool to the downhole tubular.

23. The method of claim 17, further comprising replacing components of the seal assembly to accommodate a plurality of configurations of downhole tubular.

24. A valve assembly to direct fluids from a lifting assembly and a downhole tubular, the valve assembly comprising:

a shuttle valve piston operable to block a bypass port in a first position and to reveal the bypass port in a second position;

a seal cap extending from an end of the shuttle valve piston;

a secondary piston disposed about the end of the shuttle valve piston; and a one-way valve configured to block fluids from the downhole tubular from flowing into the lifting assembly;

wherein the shuttle valve piston is configured to be thrust into the first position by the fluids from the lifting assembly acting upon the seal cap;

wherein the shuttle valve piston is configured to be thrust into the second position by the fluids from the downhole tubular acting upon the one-way valve;

wherein the secondary piston is biased to seal against the seal cap to block flow of the fluids from the lifting assembly from the downhole tubular;

wherein the secondary piston is configured to be thrust away from the seal cap by the fluids from the lifting assembly when the shuttle valve piston is in the first position.

25. The valve assembly of claim 24, wherein the one-way valve is disposed at an opposite end of the shuttle valve piston.

26. The valve assembly of claim 24, wherein the secondary piston is configured to be thrust away from the seal cap when a pressure of the fluids from the lifting assembly exceed a pressure of the fluids from the downhole tubular by an activation threshold.

27. The valve assembly of claim 26, wherein the activation threshold is a function of at least an area of the seal cap, an area of the secondary piston, and an area of the one-way valve.

28. The valve assembly of claim 27, wherein the shuttle valve piston is configured to be thrust into the second position when a pressure of the fluids from the downhole tubular exceeds a pressure of the fluids from the lifting assembly by an opening threshold.

29. The valve assembly of claim 28, wherein the opening threshold is a function of at least an area of the seal cap, an area of the secondary piston, and an area of the one-way valve.

30. The valve assembly of claim 24, wherein the one-way valve is disposed on a second end of the shuttle piston.

31. The valve assembly of claim 24, wherein the lifting assembly comprises a top-drive assembly.

* * * * *